US008339257B2

(12) United States Patent
Cazanas et al.

(10) Patent No.: US 8,339,257 B2
(45) Date of Patent: Dec. 25, 2012

(54) FIREARM AND SYSTEM FOR NOTIFYING FIREARM DISCHARGE

(75) Inventors: Carlos A. Cazanas, Bethlehem, PA (US); Brian Tims, Bethlehem, PA (US); Azam Khan, Franklin Park, NJ (US)

(73) Assignee: Cellco Partnership, Basking Ridge, NJ (US)

( * ) Notice: Subject to any disclaimer, the term of this patent is extended or adjusted under 35 U.S.C. 154(b) by 666 days.

(21) Appl. No.: 12/512,391

(22) Filed: Jul. 30, 2009

(65) Prior Publication Data

US 2011/0025491 A1 Feb. 3, 2011

(51) Int. Cl.
*G08B 1/08* (2006.01)
*F41A 9/53* (2006.01)

(52) U.S. Cl. ..... 340/539.1; 42/1.01; 340/573.1; 367/136

(58) Field of Classification Search ..... 340/539.1, 340/686.6, 573.1; 707/3, 104.1, E17.005; 342/357.06; 42/70.11, 70.01, 1.01; 705/34; 434/16; 367/128, 136; 455/456.3, 450
See application file for complete search history.

(56) References Cited

U.S. PATENT DOCUMENTS

| | | | | |
|---|---|---|---|---|
| 8,036,065 | B2 * | 10/2011 | Baxter et al. | 367/128 |
| 2002/0115444 | A1 * | 8/2002 | Yu et al. | 455/456 |
| 2003/0021188 | A1 | 1/2003 | Baranek et al. | |
| 2004/0099134 | A1 | 5/2004 | Gotfried | |
| 2006/0042142 | A1 * | 3/2006 | Sinha | 42/1.01 |
| 2008/0032268 | A1 | 2/2008 | Farrell et al. | |
| 2008/0204251 | A1 | 8/2008 | Hudson | |
| 2009/0037374 | A1 | 2/2009 | Delia et al. | |
| 2009/0095125 | A1 * | 4/2009 | Ekchian et al. | 74/572.11 |
| 2010/0115096 | A1 * | 5/2010 | Eruchimovitch et al. | 709/226 |

FOREIGN PATENT DOCUMENTS

| | | | |
|---|---|---|---|
| DE | 10 2007 062647 | A1 | 6/2009 |
| EP | 1605222 | A1 | 12/2005 |
| WO | WO 2008/048116 | A1 | 4/2008 |

OTHER PUBLICATIONS

European Office Action issued in European Patent Application No. EP 10008003.5 dated Sep. 24, 2010.
European Office Action issued in European Patent Application No. 10008003.5 dated Jun. 29, 2012.

* cited by examiner

*Primary Examiner* — Brent Swarthout

(57) ABSTRACT

A firearm equipped with a capability of wireless communication reports a discharge of the firearm to a reporting center terminal via a wireless communication link. The firearm includes a firearm housing including a trigger assembly. A sensor is coupled to the firearm housing for sensing the discharge of the firearm. The housing, e.g., portion of a pistol grip, also encases a wireless communication unit for transmitting a message indicating occurence of the firearm discharge to the terminal via wireless communication network. A GPS receiver installed in the firearm receives GPS signals from GPS satellites to enable calculation of the location of the firearm, either at the firearm or by a Position Determining Equipment (PDE), to identify the location of the firearm to the reporting center terminal. Upon detection of the discharge of the firearm, the firearm initiates activities of the GPS receiver and the wireless communication unit.

17 Claims, 4 Drawing Sheets

FIREARM AND SYSTEM FOR NOTIFYING FIREARM DISCHARGE

FIELD OF THE INVENTION

The present subject matter relates to a system for providing a notification of a firearm discharge via a wireless communication link and a firearm for sending a notification of discharge thereof via a wireless communication link.

BACKGROUND

Police officers or security guards at commercial or residential premises, who carry firearms, often face dangerous situations which force them to trigger their firearms. Safety policies of the police department or security agencies usually require the police officers or security guards to report triggering of the firearms to the police or security guard reporting center for the safety of the police officers or security guards at the dangerous spots. The reporting center has to dispatch additional police officers or security guards for safety of the police officers or security guards on the spot quickly, in response to the report of firearm's discharges, because the firearm discharge may endanger the officers or guards. While needs for prompt report of firearm's discharge exist, most imminent dangerous situation facing the police officers or security guards do not permit enough time for the officers or guards to manually report the firearm discharge via their radio links.

On the other hand, while the firearms have to be properly and safely handled by persons carrying the firearms, the firearms are often discharged by mistake or by a person who is not supposed to handle the firearms such as children or by criminals who may seize firearms from officers or guards. This careless or unwanted discharge may generate dangerous scenes accompanied with injury or death of people.

SUMMARY

Hence, a need exists for notifying a police department, a security guard agency or the like of a firearm discharge or any other dangerous movements in the firearm by using a wireless communication equipment embedded in the firearm via a wireless communication link.

Another need exists for a firearm which notifies a center to handle management of the firearm of a discharge and a location thereof a via a wireless communication device installed inside the firearm.

The teachings herein address one or more of the above noted needs relating to a firearm, a system and a method for reporting a firearm discharge to a reporting center server via a wireless communication link.

The teachings below encompass a firearm for reporting an activity therein to a reporting center terminal via a wireless communication link. The firearm comprises a trigger assembly and a firearm housing, a sensor coupled to the firearm and located within the housing for sensing a discharge of the firearm, and a wireless communication unit within the housing. The wireless communication unit transmits a message indicating occurrence of a firearm discharge to the reporting center terminal via the wireless communication network.

In an example, the wireless communication unit comprises an antenna, a transceiver for transmitting and receiving signals to enable wireless communication with the wireless network, and a GPS receiver for receiving Global Positioning System (GPS) signals from GPS satellites and a microprocessor for controlling operations of the transceiver and the GPS receiver and for responding to the sensor.

The wireless communication unit is configured to include an identification associated with the firearm data regarding location of the firearm in the transmitted message.

The GPS receiver may calculate location of the firearm based on the GPS signals received by the GPS receiver and the data included in the transmitted message comprises the location of the firearm calculated by the GPS receiver and an ID of the firearm. Alternatively, the GPS receiver takes measurements of the GPS signals to form the data. The wireless communication unit is configured to send the message containing the data to enable the PDE to calculate and send to the reporting center terminal the location of the firearm.

The transmitted message includes one or more Short Message Service (SMS) message or a Multimedia Message Service (MMS) message. In a practical example, the sensor may be an accelerometer for sensing acceleration of the firearm responsive to the discharge of the firearm. The wireless communication unit may be activated after the sensor senses the firearm discharge.

Another aspect of the disclosure encompasses a system for notifying a discharge of a firearm via a wireless communication link. The system comprises a wireless communication network, a reporting center terminal to receive a message indicating the discharge of the firearm via the wireless communication network, and the firearm. The firearm comprises a sensor coupled to the firearm and located within the housing for sensing unstable activity of the firearm, and a wireless communication unit located within the housing for transmitting the message indicating occurrence of the discharge of the firearm to the reporting center terminal via the wireless communication network in response to sensing of the firearm discharge by the sensor.

The firearm further comprises an antenna, a transceiver for transmitting and receiving signals to enable wireless communication with the wireless network, and a GPS receiver for receiving GPS signals from GPS satellites and a microprocessor for controlling operations of the transceiver, the GPS receiver and the sensor.

The GPS receiver may calculate location of the firearm based on the GPS signals and the transmitted message further includes the location of the firearm calculated by the GPS receiver and an ID of the firearm. Alternatively, a Position Determining Equipment (PDE) may receive the GPS signals from the firearm via the wireless network and calculate and send the location of the firearm to the reporting center terminal.

The transmitted message takes form of a SMS message or a MMS message.

Another aspect of the disclosure encompasses a method for reporting a discharge of a firearm to a reporting center terminal via a wireless communication link. The discharge of the firearm is detected, and then a message indicating occurrence of the discharge of the firearm is generated at the firearm. The firearm transmits message indicating the occurrence of the firearm discharge to the reporting center terminal via the wireless communication link.

The firearm receives measurements of GPS signals from GPS satellites, and calculates location of the firearm based on the received GPS signals. The location of the firearm may be calculated by the firearm, and the message sent to the reporting center terminal may include the location of the firearm and the ID of the firearm. Alternatively, a Position Determining Equipment (PDE) may receive the GPS signals via the wireless communication link and may calculate and send to the reporting center terminal the location of the firearm.

BRIEF DESCRIPTION OF DRAWINGS

The following detailed description of the embodiments of the present disclosure can best be understood when read in conjunction with the following drawing figures that depict concepts by way of example, not by way of limitations. In the figures, like reference numerals refer to the same or similar elements.

FIG. 5 is a flowchart of a process to notify a reporting center terminal of a firearm discharge or the like.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitory have been described at a relatively high-level, without detail, in order to avoid unnecessarily obscuring aspects of the present teachings.

The present subject matter encompasses a firearm equipped with a capability of wireless communication, for example, for transmitting Short Message Service (SMS) messages. A sensor to detect a firearm discharge is installed inside the firearm. The firearm also has a capability to receive Global Positioning System (GPS) signals from GPS satellites. Once the sensor installed in the firearm detects the firearm discharge, the firearm generates and transmits a SMS message indicating occurrence of the firearm discharge and GPS data to a reporting center terminal via a wireless communication network. Alternatively, the firearm itself may calculate its location based on the GPS signals and send a SMS message indicating occurrence of the firearm discharge as well as the location of the firearm.

Figure 1:
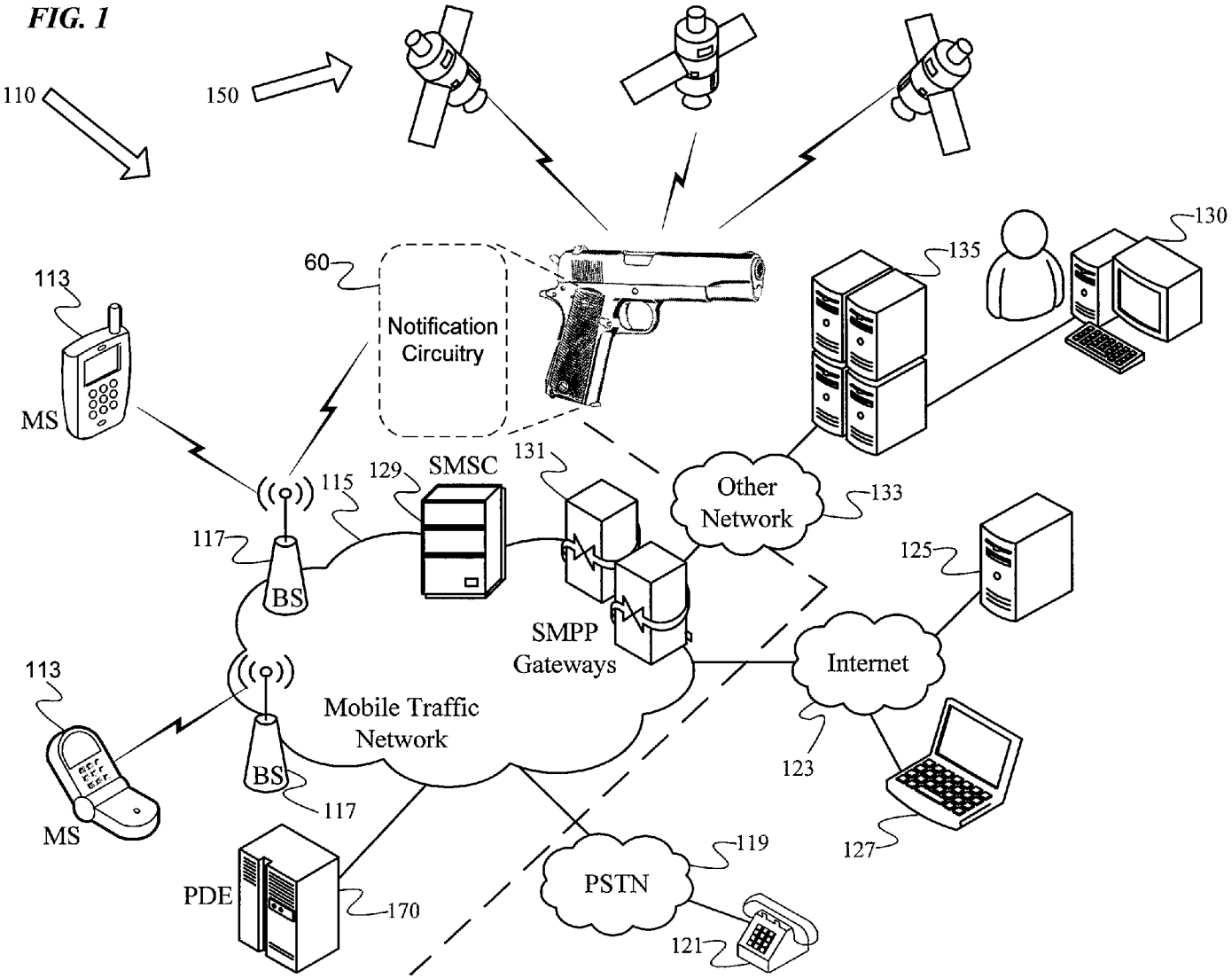
FIG. 1 illustrates a system for notifying a reporting center terminal of a firearm discharge or the like, via a wireless communication link.

FIG. 1 illustrates a system for providing notice of a firearm discharge or the like to a reporting center via a wireless communication link.

The network 110 often (but not always) comprises networks operated by a number of different mobile communication service providers, carriers or operators, although for simplicity of discussion the network 110 is assumed to be a network operated by one carrier. The communication network 110 provides mobile voice telephone communications as well as other services such as text messaging and various multimedia packet data services, for numerous mobile devices. One type of mobile device shown in the drawing is users' mobile stations 113. The network supports a variety of application services, using mobile network messaging services as the transport mechanism, where application servers/service providers offer application services typically identified by short codes. For purposes of the present discussion, the drawings show an example in which the application service relates to a notification service of a firearm discharge from a handgun or other firearm. Hence, the drawing shows a handgun 50 equipped with notification circuitry 60. The handgun 50 has capabilities to communicate via the wireless mobile communication network 110 and to receive Global Positioning System (GPS) signals from GPS satellites 150.

In normal operation, the network 100 allows the mobile stations 113 that are currently operating through the network to initiate messages to other elements connected to the wireless network 110, the internet 123, the PSTN 119 or the like. The network 110 typically offers a variety of text and other data services, including services via the Internet 123, such as downloads, web browsing, e-mail, etc. via servers shown generally at 125 as well as message communications with terminal devices represented generally by the personal computer (PC) 127. A number of the data services provide messaging services. Examples of such services include SMS, EMS and MMS. Although the present teachings may be applied to any of these or other types of messaging services, for purposes of a specific example to discuss here, we will assume that the network 110 allows SMS type text messaging between mobile stations 113 and similar messaging with other devices, e.g. via the Internet 123.

At least the SMS service is also available, as needed, to the notification circuitry 60 in the handgun 100. The communication elements and location elements of the circuitry 60 within the handgun 100 are generally similar to corresponding elements of a regular mobile station 113. To the wireless mobile communication network 110, each handgun 100 is provisioned and operates in a manner generally similar to a mobile station (MS) 113, although the network services available to the circuitry 60 may be somewhat limited in comparison to those available to various mobile stations 113. For example, the handgun 100 may be provisioned only to send/receive SMS type messaging communications to/from call center(s) or the like of a law enforcement agency or a weapon monitoring service provider(s).

The network 110 may implement wireless communications with the mobile stations 113 (and similar circuitry 60 in the handguns 100) via any of a variety of different standard communication technologies common in public wireless mobile communication networks. Examples of such technologies include various CDMA standards, including 3GPP2 variants thereof (e.g. 1XRTT or EVDO), as well as TDMA and GSM standards including 3GPP variants (e.g. LTE or UMTS). The mobile stations 113 and the communications elements of the handgun 100 would be configured to communicate in accord with the wireless standard supported by the network 110, although many such mobile devices have the capability of communicating via a number of networks that may utilize different standardized technologies (multi-mode devices).

The mobile communication network 110 typically is implemented by a number of interconnected networks. Hence, the overall network 110 may include a number of radio access networks (RANs), as well as regional ground networks interconnecting a number of RANs and a wide area network (WAN) interconnecting the regional ground networks to core network elements, such as SMS messaging centers (SMSCs) 129 and/or multimedia messaging centers (MMSCs—not shown). A regional portion of the network 110, such as that serving mobile stations 113 and the handgun 100 will typically include one or more RANs and a regional circuit and/or packet switched network and associated signaling network facilities.

Physical elements of a RAN operated by one of the mobile service providers or carriers, include a number of base stations represented in the example by the base stations 117.

Although not separately shown, such a base station (BS) 117 typically comprises a base transceiver system (BTS) which communicates via an antenna system at the site of the base station and over the airlink with one or more of the mobile devices 113 or the circuitry 60 in the handgun 100, when the mobile devices are within range. Each base station (BS) 117 typically includes a BTS coupled to several antennas mounted on a radio tower within a coverage area often referred to as a "cell." The BTS is the part of the radio network that sends and receives RF signals to/from the mobile devices that the base station currently serves.

The radio access networks also include or connect to a traffic network represented generally by the cloud shown at 115, which carries the user communications for the mobile stations 113 and the handgun 100 between the base stations 117 and other elements with or through which the various wireless mobile devices communicate. Individual elements such as switches and/or routers forming the traffic network 115 are omitted here for simplicity.

The traffic network portion 115 of the mobile communication network 100 connects to the public switched telephone network (PSTN) 119. This allows the network 100 to provide voice grade call connections between mobile stations 113 and regular telephones connected to the PSTN 119. The drawing shows one such telephone at 121. This interconnection supports regular voice telephone traffic of the mobile stations 113 as well as voice communications for the officers or guards, for example, with telephone equipment (not shown) at one or more call centers of the agencies or companies providing the weapons monitoring application service.

The traffic network portion 115 of the mobile communication network 100 connects to a public packet switched data communication network, such as the network commonly referred to as the "Internet" shown at 123. As noted earlier, packet switched communications via the traffic network 115 and the Internet 123 may support a variety of user services through the network 110, such as mobile station communications of text and multimedia messages, e-mail, web surfing or browsing, programming and media downloading, etc. For example, the mobile stations 113 may be able to receive messages from and send messages to user terminal devices, such as personal computers, either directly (peer-to-peer) or via various servers. The drawing shows one such user terminal device as a personal computer (PC) at 127 and one sever 125, by way of example. Although a different approach is illustrated, the messaging for the handgun 100 could go via the Internet 123.

For purposes of the discussion of handling of messaging traffic related to weapons monitoring, by manipulations based on short codes, we will concentrate on an SMS type implementation of the messaging service that carries or transports the data portion of the weapons related application service communications through the network 110. Those skilled in the art will recognize, however, that the firearm discharge reporting service may utilize other types of the messaging services available in the typical wireless mobile communication network 110, and that the present concepts are equally applicable to the discharge reporting services using those other types of messaging services through the network.

Wireless carriers developed the short message service (SMS) to transmit text messages for display on the mobile stations. In many existing network architectures, the SMS traffic uses the signaling portion of the network 115 to carry message traffic between a Short Message Service Center (SMSC) 129 and the mobile stations 113. The SMSC 129 supports mobile station to mobile station delivery of text messages. However, the SMSC 129 also supports communication of messages between the mobile stations and devices coupled to other networks. For example, the SMSC 129 may receive incoming IP message packets from the Internet 123 for delivery via the network 115, one of the base stations 117 and a signaling channel over the air link to a destination mobile station 113. For this later type of SMS related communications, the network 110 also includes one or more Short Message Peer-to-Peer (SMPP) protocol gateways 131. The SMPP gateway 131 provides protocol conversions, between SMPP as used by the SMSC 129 and the protocols used on the Internet 123 or other IP network 133. SMPP messages ride on IP transport, e.g. between the gateway 131 and the SMSC 129.

The exemplary system also includes one or more other packet communication networks 133 connected to the mobile network 110. The network 133 may be a private packet data network operated by the same carrier that operates network 110 for its own purposes, or the network 133 may be a secure network interconnected among several parties working together to provide certain secure services. Alternatively, the network 133 may be the Internet 123. Of note for purposes of the present discussion, the network 133 provides packet data communications between the gateway (GW) 131 to the traffic network 115, for a number of application servers. Of note for purposes of this discussion of firearm discharge reporting, one such application server 135 processes SMS messages from handguns 100 and provide the messages to one or more associated reporting center terminals 130.

A reporting center terminal 130 receives the SMS message sent from the handgun 100 including notification of the firearm discharge and/or location of the handgun 100. The reporting center terminal 130 could be a device closely associated with the host server 135, as shown at 130 or the terminal may be the PC 127 to receive a message converted from the SMS message, or a telephone 121 to receive voice call converted from the SMS message. Alternatively, the terminal could be a mobile terminal 113 to receive the SMS message from the handgun directly.

As noted earlier, in the discussion regarding the various mobile devices, the present discussion is applicable to a variety of application services, using mobile network messaging services as the system for notifying a firearm discharge of the handgun having a mobile communication link with the network 133.

The present discussion of message handling focuses on the message processing, that is to say the processing of the SMS messages in the handgun 100. Hence, voice call elements related to the handgun monitoring for discharge notification are omitted here for convenience.

Figure 2:
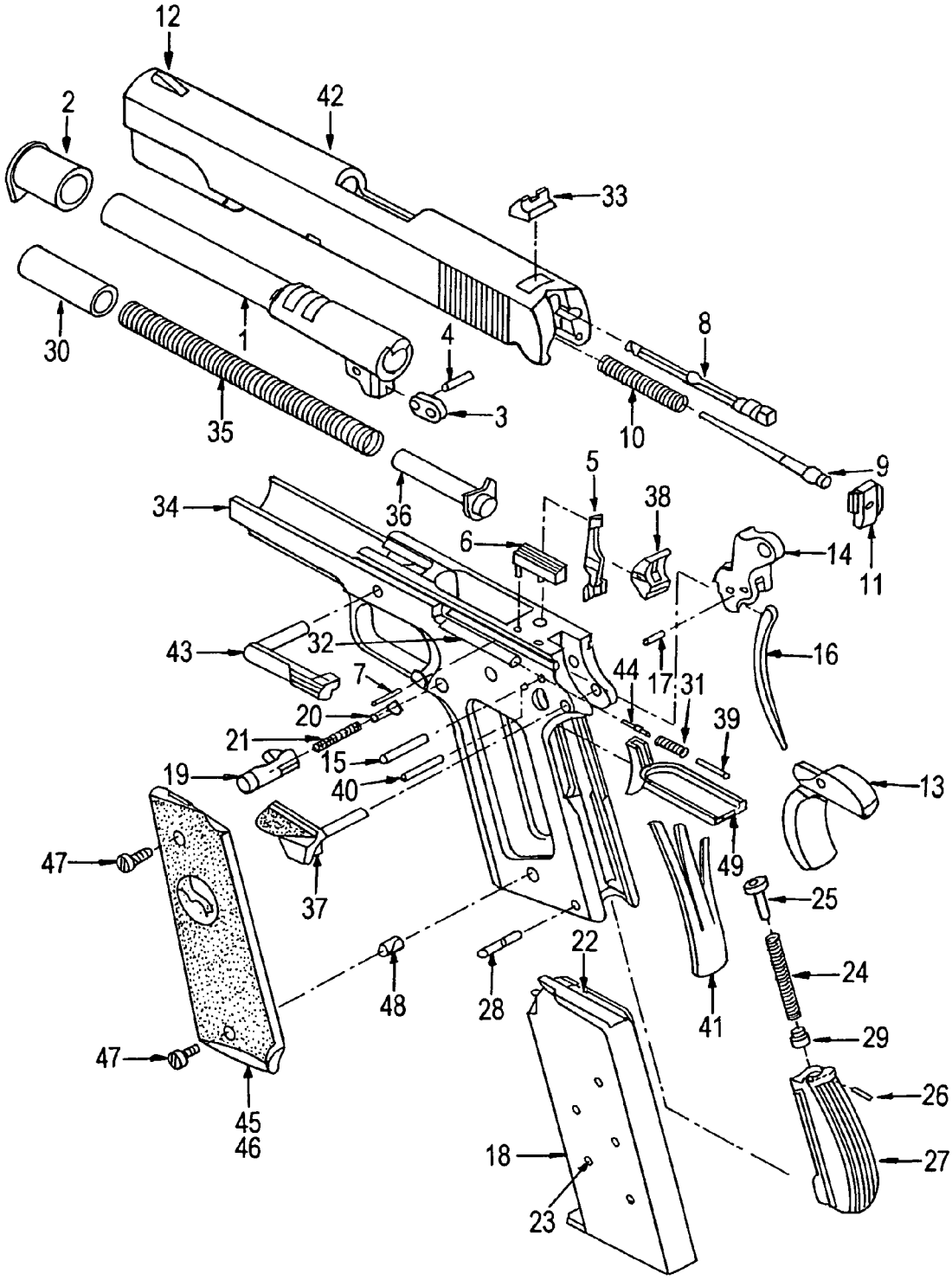
FIG. 2 illustrates a schematic diagram of a handgun.

FIG. 2 illustrates a schematic diagram of a handgun 100. While the present subject matter is applicable to other type firearms, such as rifles, shotguns or other types of handguns, our discussion will be presented based on the exemplary automatic type handgun of FIG. 1. The handgun includes a barrel assembly 1-4, a disconnector 5, a ejector assembly 6-7, an extractor 8, a firing assembly 9-11, a front sight 12, a grip safety 13, a hammer assembly 14-17, a magazine assembly 18-23, a main spring assembly 24-29, a recoil spring plug 30, a plunge spring and a plunge tube 31, 32, a rear sight 33, a receiver 34, a recoil spring and a recoil spring guide 35, 36, a safety lock and a safety lock plunger 37, 38, and a sear assembly 39-41, a slide assembly 42-44, a left hand and a right hand grip stock 45, 46, stock screws and a stock screw brushings 47, 48 and a trigger assembly 49. While detailed descriptions of the handgun elements of FIG. 1 are omitted, basic operation of the handgun 100 discharges bullets installed in the magazine assembly 18-23 via the barrel assembly 1-4 by putting person's hand on the trigger assembly 49 and pulling the trigger assembly 49. Of note for purpose of this discussion, circuitry for detecting a discharge and transmitting one or more notification messages is incorporated into a housing of the gun, for example, in the one of the grip plates or stocks 45, 46.

Figure 3:
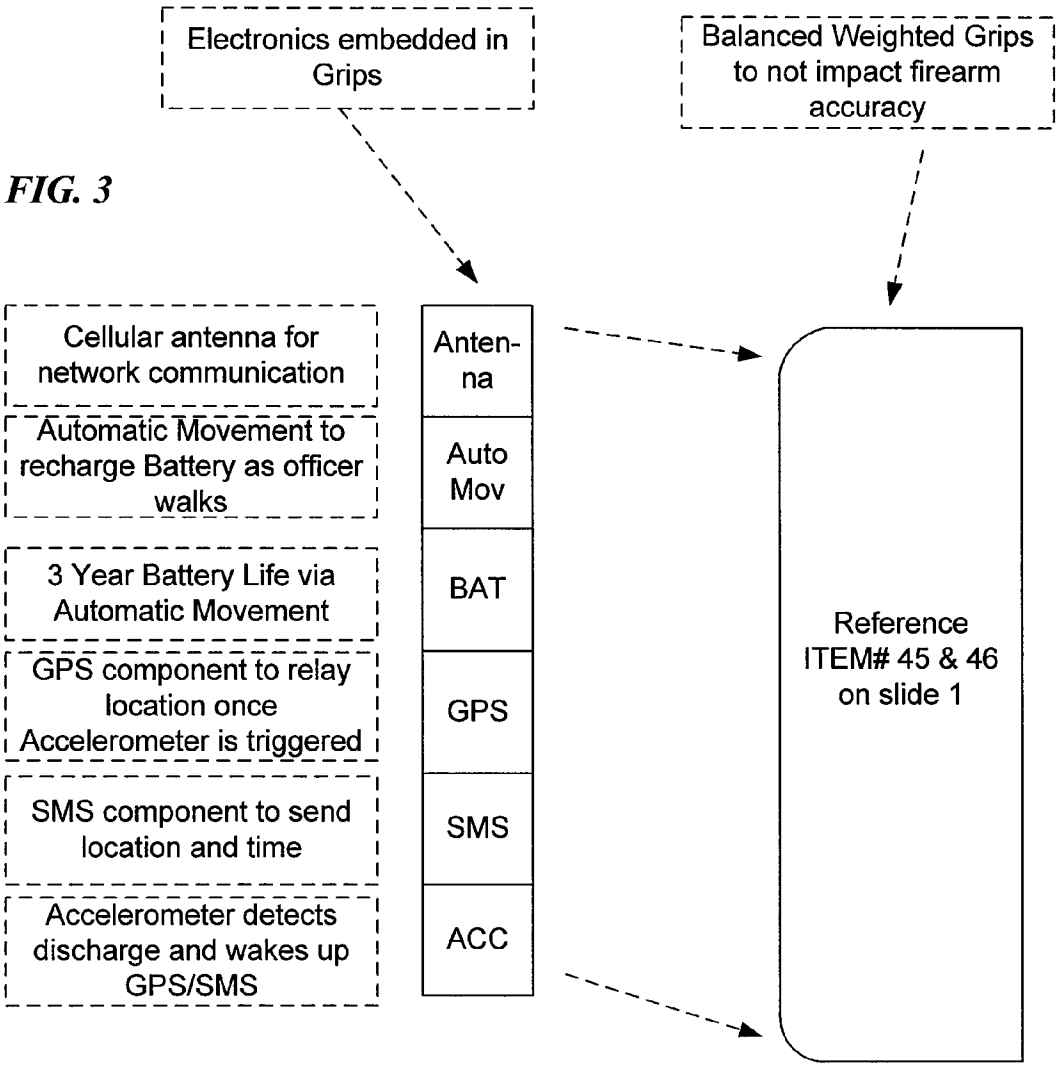
FIG. 3 is a block diagram of functional elements installed inside the handgun of FIG. 2 for sensing movement of the handgun caused by a discharge and for sending Short Message Service (SMS) messages and Global Positioning System (GPS) data via a wireless communication link.

The handgun 100 includes a circuit 60 implementing an accelerometer 61 to sense movement of the handgun and a wireless communication equipment to send SMS messages. FIG. 3 is a diagram of functional elements of the circuitry 60 installed inside the handgun 100. The circuitry 60 may be installed inside the grip plates or stocks 45, 46 of the handgun 100 or other secured inside portions of the handgun not to impact accuracy of functions illustrated in FIG. 3. The circuitry 60 implements an antenna to receive GPS signals from the satellites 150 and send SMS messages, and a battery rechargeable by movement of officers or guards. The circuitry 60 implements an accelerometer to detect a discharge of the handgun 100, GPS components to relay location once the accelerometer is triggered, and SMS components to send location of the handgun 100 and time.

Figure 4:
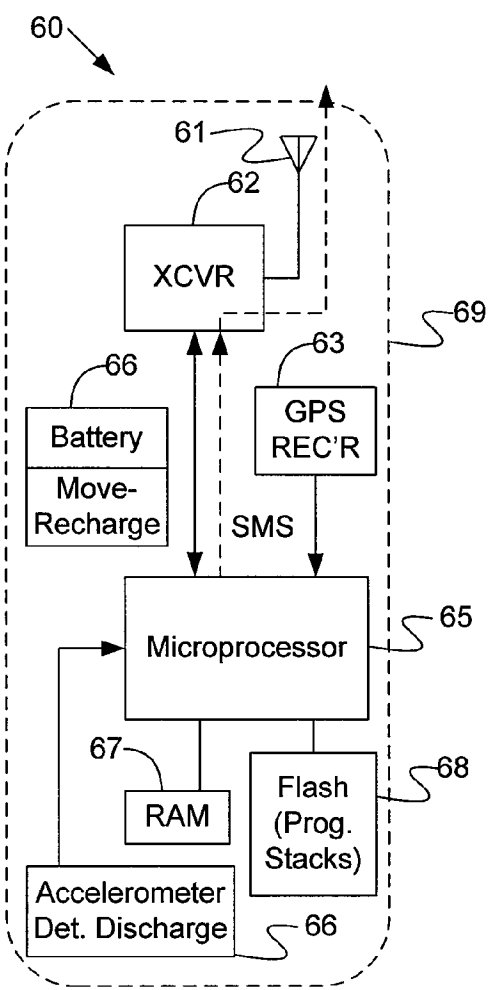
FIG. 4 is a schematic diagram of a circuit implementing the functional elements of FIG. 3 installed inside the handgun of FIG. 2.

FIG. 4 is a schematic diagram of the circuitry 60 to implement the functional elements of FIG. 3. The circuit 60 may be equipped inside relatively stable areas of the handgun 100, for example inside the left hand or right hand stock 45, 46, as noted in the discussion of FIG. 1.

Referring to FIGS. 3 and 4, for digital wireless communications, the circuit 60 includes a digital transceiver (XCVR) 62, in this case, compatible with digital wireless communications with the base station 117 (FIG. 1). The concepts discussed here encompass any digital transceivers that conform to current or future developed digital wireless communication standards. For example, the transceiver 62 could be a CDMA-2000, 1xRTT, or EVDO unit or the like designed for cellular or PCS operation or a transceiver for WiFi/WLAN type operation. The transceiver 62 provides two-way wireless communication of information, such as digital message information. If compatible with the base station 117, the communications via the transceiver could include transmitting of SMS messages. Via the base station 117, the communications via the transceiver 62 all utilize SMS message services. The transceiver also sends and receives a variety of signaling messages via the handgun 100 and the network. The transceiver 62 connects through RF send and receive amplifiers (not separately shown) to an antenna 61. The circuit 60 may include one or more additional transceivers, as shown in dotted line form, for operation in accord with an alternative digital standard. The IP packet transport can be used instead of the SMS messages as a way to communicate with the base station 117.

A sensor could be provided to sense pulling of the trigger assembly 49, for example, by being coupled to the trigger assembly 49. In the example, however, an accelerometer 64 measures the acceleration it experiences relative to freefall and detects magnitude and direction of the acceleration as a vector quantity. The accelerometer 64 may senses unstable movement of the handgun by being attached to other elements of the handgun. The accelerometer 64 may be separately implemented and installed inside the handgun 100 from the circuit 60 to send SMS messages and receive GPS data. Other type sensors to sense movement of the handgun such as a motion sensor, a thermal sensor, and a pressure sensor may substitute for the accelerometer 61. Once the accelerometer 64 senses the firearm discharge or unstable movement, the accelerometer 64 notifies the microprocessor 65 of its sensing. The microprocessor 65 may wake up and turn-on the GPS receiver 63 and the transceiver 62, which were previously dormant for saving power of the battery 66.

The GPS receiver 63 receives GPS signals from the GPS satellites 150. Each of the GPS satellites 150 continually transmits messages containing the time the message was sent, precise orbital information (the ephemeris), and the general system health and rough orbits of all GPS satellites (the almanac). The receiver 63 measures the transit time of each message as a representation of the distance to each satellite. Geometric trilateration is used to combine these distances with the location of the satellites to determine the receiver's location.

If the receiver 63 has sufficient processing capabilities, for example, the receiver calculates its position by precisely timing the signals sent by the GPS satellites 150 high above the Earth. The GPS receiver 63 sends calculated its position data to the microprocessor 65, which now serves as an SMS generator. Alternatively, the GPS receiver 63 could send the message containing the satellite identifications and transit time measurements, as the location related data, to the mobile network 115 and a Position Determining Equipment (PDE) 170 with location decision capabilities. In this later example, the PDE 170 processes the raw data from the handgun to calculate the location of the handgun 100. The PDE 170 is essentially a general purpose programmable device with an interface for data communication via the network 115 running server software and running programming for implementation of the PDE 170 functions. The PDE 170 stores (e.g. in cache memory) or has access to a complete and up to date set of the satellite data for the constellation of GPS satellites needed to allow computation of position based on pseudorange measurements from satellite signals as received from the handgun or from other mobile devices.

When triggered by the accelerometer 66, the microprocessor 65 generates a SMS message indicating the firearm discharge or unstable movement of the handgun based on the signal received from the accelerometer 64. The SMS message also includes data regarding the location of the handgun 100 calculated by the GPS receiver 63. Alternatively, as addressed above, when the server of the mobile network calculates the location of the handgun, the SMS message may include the satellite signal measurement data instead of the actual location of the handgun 100. The generated SMS message is sent to the wireless network via the transceiver 62 and the antenna 61. While the SMS messages are employed as a way to inform the firearm discharge to a reporting center, other ways such as MMS messages may be used.

The battery 66 is also installed in the circuitry 60. The battery 66 may be rechargeable by movement of a firearm carrier. The microprocessor 65 may start to supply power from the battery 66 to the GPS receiver 63 after detection of the firearm discharge. The microprocessor 65 controls operations of the transceiver (XCVR) 62, the GPS receiver 63 and the battery 66. A Random Memory Access (RAM) 67 and Flash Read Only Memory (ROM) 68 are coupled to the microprocessor 65 to store and retrieve any applications executed by the microprocessor 65 and hold any data processed through the microprocessor 65.

Figure 5:
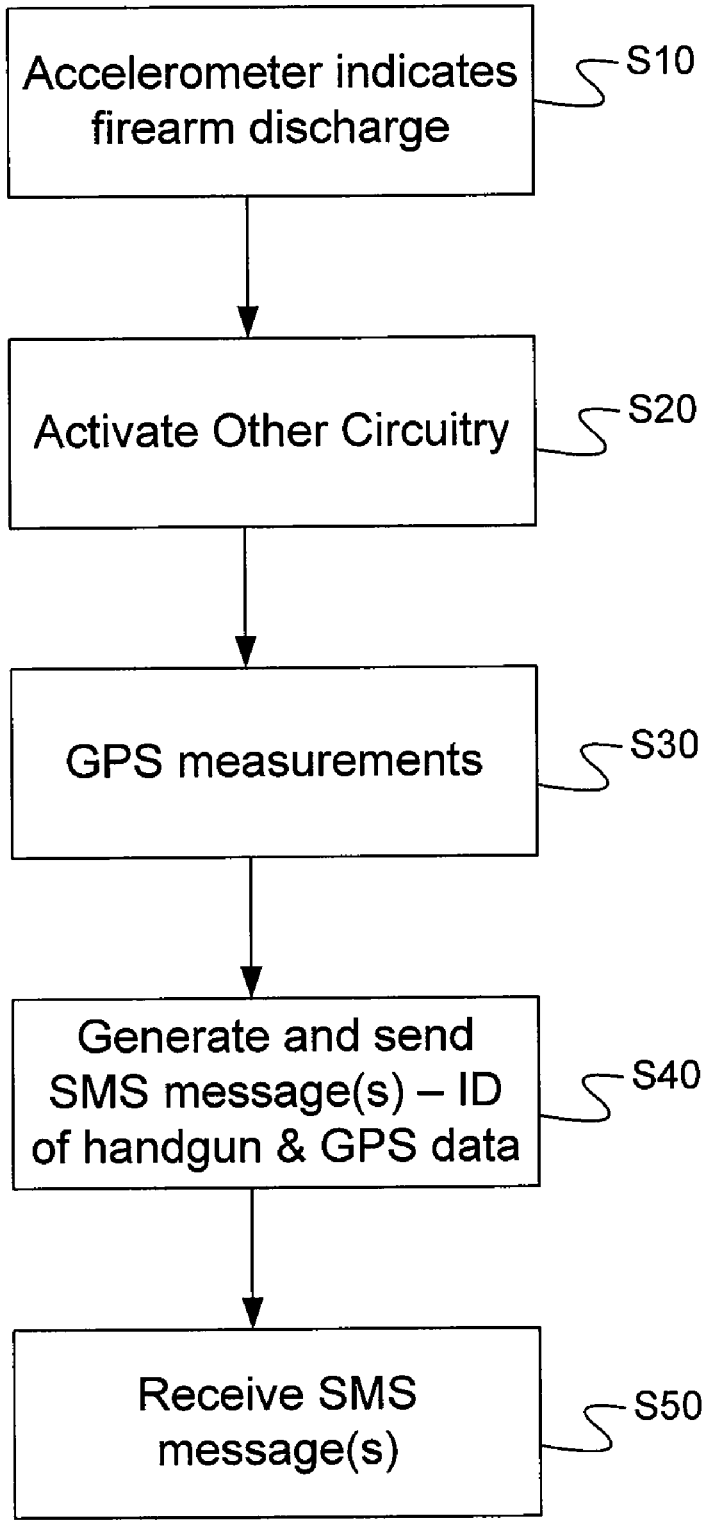

FIG. 5 is a flowchart of process to notify a reporting center terminal 130 of a discharge or the like of the handgun type firearm 100. When the accelerometer 66 detects a firearm discharge, the accelerometer 66 indicates the firearm discharge to the microprocessor 65. (S10) The microprocessor 65 wakes-up and activates other elements of the circuitry 60 including the GPS receiver 63 and transceiver 62, which have been powered off for saving power in the battery 66 by supplying power from the battery 66 to the elements of the circuitry 60 including the GPS receiver 63. (S20)

Upon activation, the GPS receiver 63 receives the GPS data from satellites. The receiver 63 may calculate its location based on the GPS data. (S30) The GPS receiver 63 may only receive the GPS measurement data from the satellites without calculating the position based on the GPS measurement data therein, and send the SMS message indicating the firearm discharge and the GPS data to a Position Determination Equipment (PDE) 170 or the like via the wireless network 100. In this later case, the PDE 170 or the like calculates the location of the handgun and sends the location to the reporting center terminal.

After the GPS receiver 63 receives the GPS data (or calculates the location of the handgun), the microprocessor 65 generates a SMS message including indication of the firearm discharge, an ID of the handgun, by which carrier of the handgun is identified, and/or location of the handgun, and sends the SMS message to the reporting center terminal via the wireless network 110. (S40) The reporting center terminal 300 receives the SMS message transmitted via the wireless communication network 110 from the handgun 100. (S50) After receiving the SMS message, the reporting center terminal 300 takes actions to contain the dangerous situation caused by the firearm discharge by dispatching supporting personnel to the location of the handgun included in the SMS message. This prompt reaction to the firearm discharge without need of reporting by the police officers or security guards at the scene saves the police officers or security guards from more dangerous situations.

The handgun 100 may send beacon signals including its location information periodically to the reporting center terminal 130 to keep informed of the location of the handgun 100 regardless of detection of the discharge of the handgun. This periodic report of the location of the handgun enable the police department or security agency to quickly dispatch supporting personnel to the location of the handgun, i.e. criminal spot, when the firearm discharge is detected.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A firearm for reporting activity therein to a reporting center terminal via a public wireless mobile communication network, comprising:

a firearm including a trigger assembly coupled to a housing;

a sensor coupled to the firearm and located within the housing for sensing a discharge of the firearm; and a wireless communication unit within the housing configured to transmit a message to a base station of the public wireless mobile communication network indicating occurrence of the discharge of the firearm for communication to the reporting center terminal, in response to sensing of the firearm discharge by the sensor, wherein:

the wireless communication unit comprises:

an antenna;

a transceiver for transmitting wireless mobile communication signals to enable wireless communication through the public wireless mobile communication network;

a Global Positioning System (GPS) receiver for receiving GPS signals from GPS satellites; and a microprocessor for controlling operations of the transceiver and the GPS receiver and for responding to the sensor, the wireless communication unit is configured to include an identification associated with the firearm and data regarding location of the firearm in the transmitted message, and the message transmitted by the wireless communication unit located within the housing includes one or more of a Short Message Service (SMS) message or a Multimedia Message Service (MMS) message configured to be processed by a Short Message Peer-to-Peer (SMPP) protocol gateway providing protocol conversion between the SMPP protocol and Internet protocols.

2. The firearm of claim 1, wherein the GPS receiver calculates location of the firearm based on the GPS signals and the data included in the transmitted message comprises the location of the firearm calculated by the GPS receiver.

3. The firearm of claim 1, wherein:

the GPS receiver takes measurements of the GPS signals to form the data; and the wireless communication unit is configured to send the message containing the data to a Position Determining Equipment (PDE) to enable the PDE to calculate and send to the reporting center terminal the location of the firearm.

4. The firearm of claim 1, wherein the sensor includes an accelerometer for sensing acceleration of the firearm responsive to the discharge of the firearm.

5. The firearm of claim 1, wherein the wireless communication unit is activated after the sensor senses the discharge of the firearm.

6. The firearm of claim 1, wherein the wireless communication unit is configured to send beacon signals to the reporting center terminal periodically to notify the reporting center terminal of the location of the firearm.

7. A system for notifying of a firearm discharge via a wireless communication link, comprising:

a public wireless mobile communication network;

a reporting center terminal configured to receive a message indicating the discharge of the firearm via the public wireless mobile communication network; and a firearm comprising:

a trigger assembly coupled to a housing;

a sensor coupled to the firearm and located within the housing for sensing a discharge of the firearm; and a wireless communication unit within the housing configured to transmit a message to a base station of the public wireless mobile communication network indicating occurrence of the discharge of the firearm for communication to the reporting center terminal, in response to sensing of the firearm discharge by the sensor, wherein:

the wireless communication unit comprises:

an antenna;

a transceiver for transmitting wireless mobile communication signals to enable wireless communication with through the public wireless mobile communication network;

a Global Positioning System (GPS) receiver for receiving GPS signals from GPS satellites; and a microprocessor for controlling operations of the transceiver and the GPS receiver and for responding to the sensor, the wireless communication unit is configured to include an identification associated with the firearm and data regarding location of the firearm in the transmitted message, and the message transmitted by the wireless communication unit located within the housing includes one or more of a Short Message Service (SMS) message or a Multimedia Message Service (MMS) message configured to be processed by a Short Message Peer-to-Peer (SMPP) protocol gateway providing protocol conversion between the SMPP protocol and Internet protocols.

8. The system of claim 7, wherein the system further includes a Position Determining Equipment for receiving the GPS signals from the firearm via the public wireless mobile communication network and calculating and sending the location of firearm to the reporting center terminal.

9. The system of claim 7, wherein the wireless communication unit is configured to send beacon signals to the reporting center terminal periodically to notify the reporting center terminal of the location of the firearm.

10. A method for reporting a discharge of a firearm to a reporting center terminal via a public wireless mobile communication network, comprising steps of:

(a) detecting a discharge of the firearm;

(b) receiving global positioning system (GPS) signals from GPS satellites at the firearm;

(c) calculating location of the firearm based on the received GPS signals;

(d) generating a message indicating occurrence of the discharge of the firearm at the firearm, the calculated location of the firearm, and an identification associated with the firearm; and (e) transmitting, from a wireless communication unit of the firearm located within a housing of the firearm to a base station of the public wireless mobile communication network, the message indicating the occurrence of the discharge of the firearm for communication to the reporting center terminal, wherein the message transmitted by the wireless communication unit located within the housing includes one or more of a SMS message or a MMS message configured to be processed by a Short Message Peer-to-Peer (SMPP) protocol gateway providing protocol conversion between the SMPP protocol and Internet protocols.

11. The method of claim 10, wherein, in the step (c), the location of the firearm is calculated by the firearm.

12. The method of claim 10, wherein, in the step (c), measurements of the received GPS signals are sent to a Position Determining Equipment (PDE) via the wireless network, and the PDE calculates and sends to the reporting center terminal the location of the firearm.

13. The firearm of claim 1, further comprising a battery configured to be rechargeable by movement of a carrier of the firearm.

14. The firearm of claim 1, wherein the transceiver transmits the message indicating occurrence of the discharge of the firearm by transmitting the message from the antenna for reception by the base station of the public wireless mobile communication network.

15. The firearm of claim 6, wherein the beacon signals are sent periodically regardless of detection of a discharge of the handgun.

16. The system of claim 7, wherein the transceiver transmits the message indicating occurrence of the discharge of the firearm by transmitting the message from the antenna for reception by the base station of the public wireless mobile communication network.

17. The system of claim 9, wherein the beacon signals are sent periodically regardless of detection of a discharge of the handgun.

* * * * *